US005738200A

United States Patent [19]

Bruner

[11] Patent Number: 5,738,200

[45] Date of Patent: Apr. 14, 1998

[54] COIN RECEIVING ASSEMBLY FOR SEPARATING LIQUIDS FROM COINS

[75] Inventor: Philemon L. Bruner, Katy, Tex.

[73] Assignee: Imonex Services, Inc., Katy, Tex.

[21] Appl. No.: 512,781

[22] Filed: Aug. 9, 1995

[51] Int. Cl.[6] ..... G07F 1/04

[52] U.S. Cl. ..... 194/348

[58] Field of Search ..... 194/344, 347, 194/348, 349, 334, 338

[56] References Cited

U.S. PATENT DOCUMENTS

| | | | |
|---|---|---|---|
| 2,014,505 | 9/1935 | Patche | 194/338 |
| 4,165,802 | 8/1979 | Mathews | 194/344 |
| 4,911,280 | 3/1990 | Bruner | 194/338 |
| 5,027,937 | 7/1991 | Parish et al. | 194/348 |
| 5,156,250 | 10/1992 | Parish et al. | 194/348 |

FOREIGN PATENT DOCUMENTS

| | | | |
|---|---|---|---|
| 2-144689 | 6/1990 | Japan | 194/348 |

*Primary Examiner*—F. J. Bartuska
*Attorney, Agent, or Firm*—Arnold White & Durkee

[57] ABSTRACT

The coin receiving assembly provides a mechanism for defining a coin race through which a coin may pass, but from which fluid will be caused to exit. The coin is caused to negotiate a generally curvilinear path, while surfaces defining the coin race are configured to conduct water to locations away from the coin race. Additionally, apertures are provided toward a latter portion of the arcuate coin path to facilitate drainage of fluids otherwise adhering to surfaces defining the coin path.

14 Claims, 3 Drawing Sheets

FIG. 1
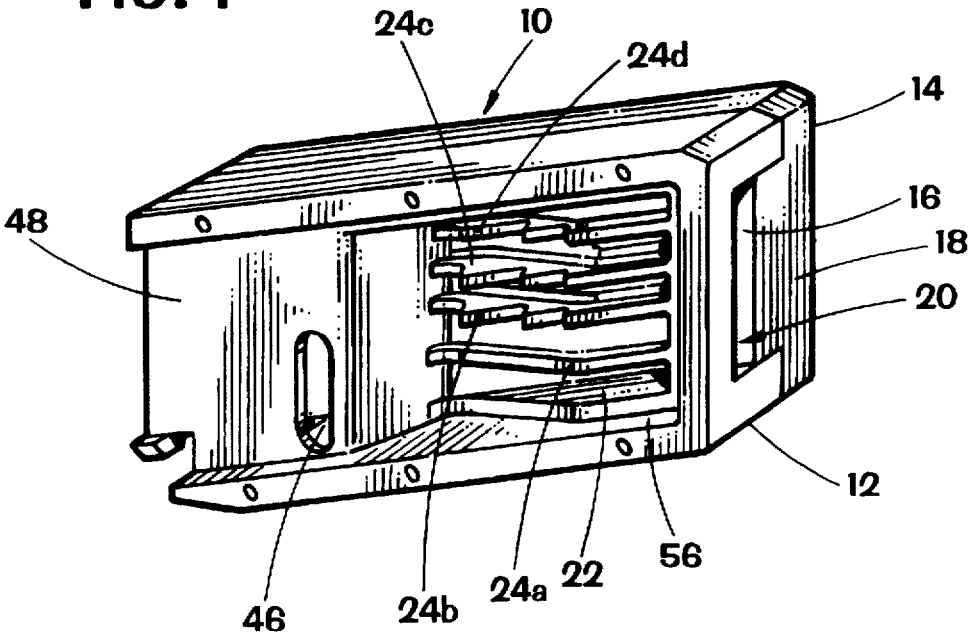
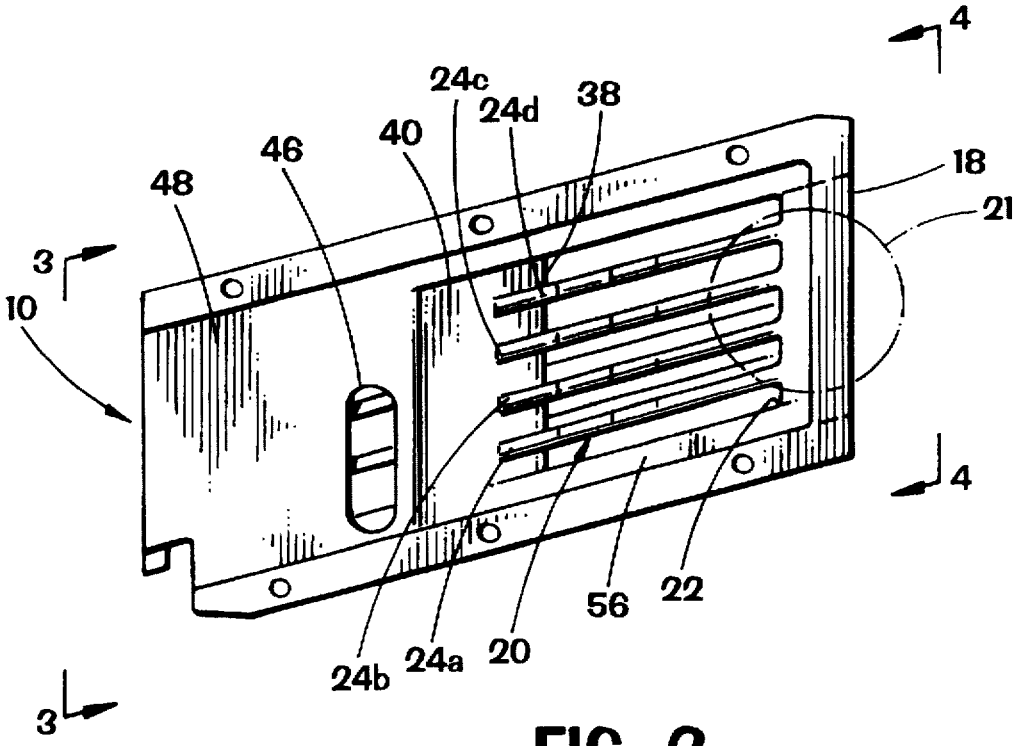
FIG. 2

FIG. 3
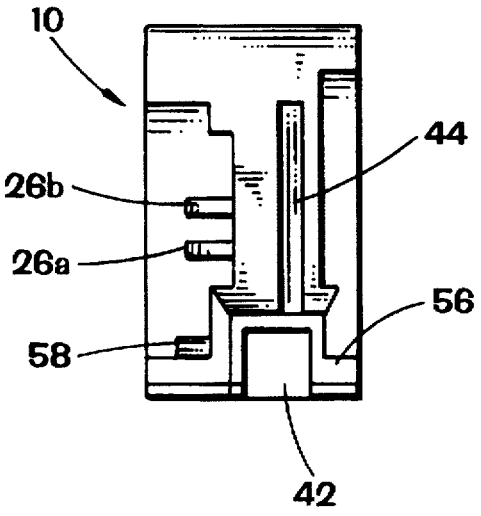
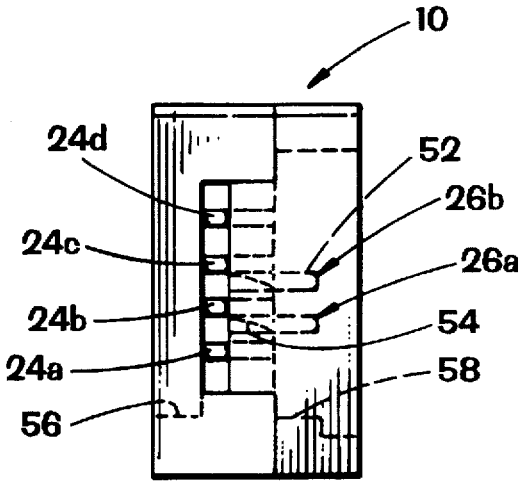
FIG. 4
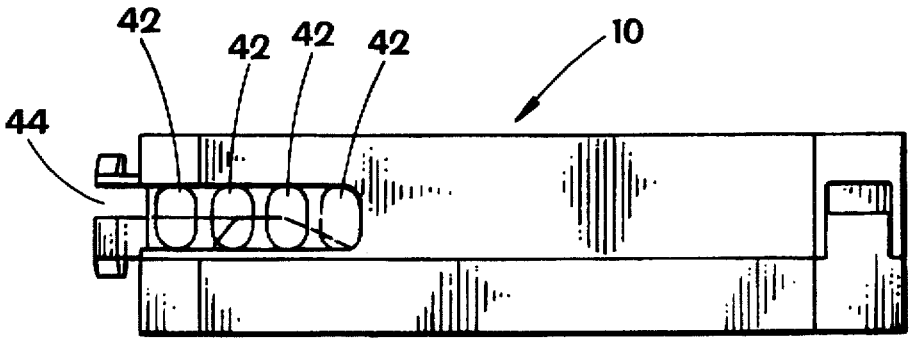
FIG. 5

FIG. 6
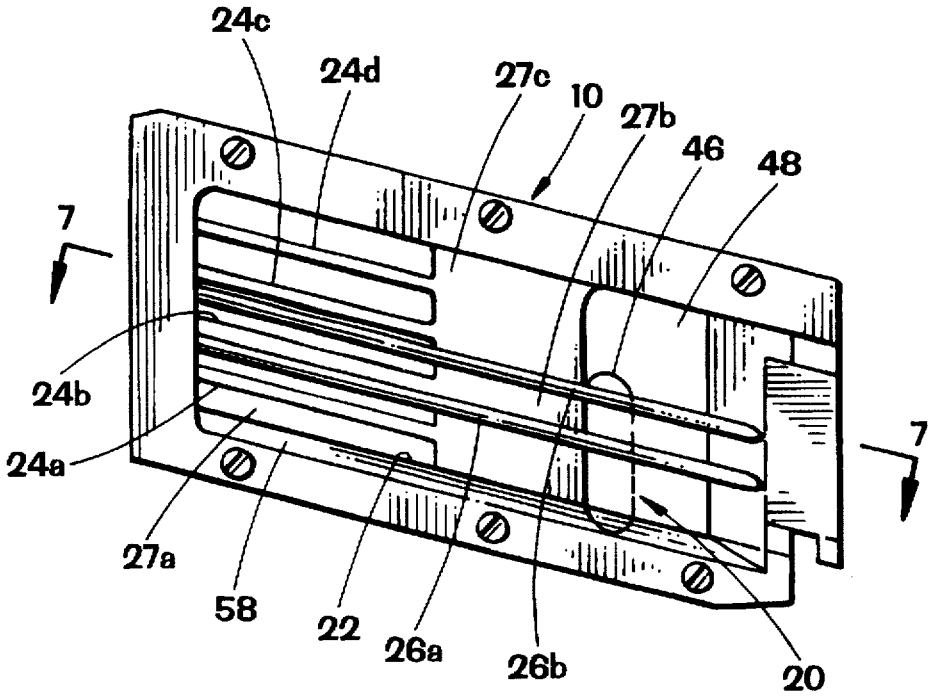
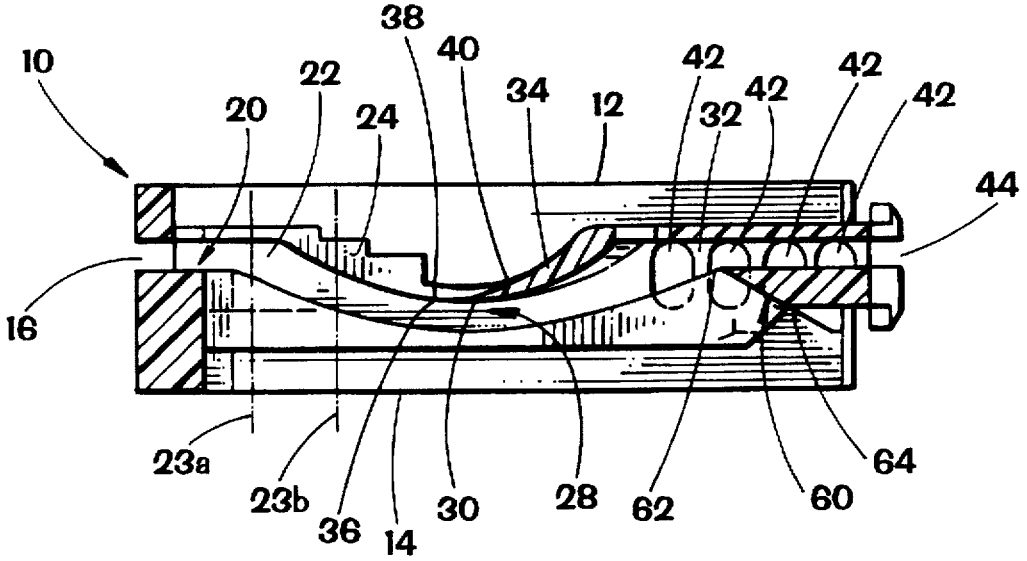
FIG. 7

COIN RECEIVING ASSEMBLY FOR SEPARATING LIQUIDS FROM COINS

BACKGROUND OF THE INVENTION

The present invention relates generally to coin receiving assemblies; and more specifically, relates to coin receiving assemblies and their methods of use to separate liquids from coins and/or to prevent the passage of liquid through a coin path into the remainder of a coin receiving and counting mechanism.

As is well known in the coin-operated machine industry, a primary problem encountered by the owners and operators of such machines is vandalism to the machines, typically initiated as part of an attempt to improperly obtain money from the machines. Many types of such vandalism are known. For example, Applicant's application Ser. No. 08/416,178, filed on Apr. 4, 1995, now abandoned entitled Coin Receiving Apparatus, filed in the name of Philemon L. Bruner, addresses an assembly to thwart vandalism by stuffing paper or other materials into a coin race so as to collect coins by unsuspecting potential customers. This stuffing is then subsequently removed by the vandal, along with the coins which had been inserted but retained by the stuffing.

Another type of vandalism which has become a plague to the coin-operated machine industry, is vandalism by forcing liquids into the coin race of the machine to short circuit the machine, thereby often causing disgorging of coinage collected in the machine. For example, a conductive salt water solution is poured into the coin receiving assembly of a machine. This conductive salt water passes through the machine, short circuiting the electronics in the machine, and in many cases causing dispensing of coins previously collected therein. While this improper obtaining of coins from the machine is highly problematic, the even more problematic problem facing the machine owner/operators is the extreme damage, and often ruination, of the coin totalizing and escrow assembly; and often of other structures of the machine. The coin totalizing and escrow assembly may cost $200–800 or more to replace.

Devices have been proposed in the prior art to divert liquids away from a coin path. However, actual prior art devices available to the industry have not been successful in diverting a sufficient volume of liquid to serve the needs of the industry. An example of such a prior art device is that depicted in U.S. Pat. No. 5,027,937, issued Jul. 2, 1991, to Parish et al. Accordingly, the present invention provides a new method and apparatus for separating liquids from a coin path, facilitating the diversion of liquids to a path where potential destructiveness will be minimized.

SUMMARY OF THE INVENTION

The coin receiving assembly in accordance with the present invention defines a non-linear coin path, in combination with apertures on either side of the coin path to promote separation of liquids from the path the coin will follow through the coin receiving assembly.

In an exemplary preferred embodiment, the coin race will define a generally rectangular cross-section. This cross-section will have a short side and a long side. The coin race will deflect in a direction substantially parallel to the short side of the coin race. In a particularly preferred embodiment, this deflection will be caused by a protrusion defining an arcuate coin path. Also in this particularly preferred embodiment, the coin race will maintain a coin in an on-edge orientation on a coin race floor, and the deflection will be in a direction across the coin race floor.

In the exemplary preferred embodiment described and illustrated herein, additional structures are presented to optimize the separation. For example, the liquid exit apertures are defined in part by elongated guide ribs which are configured both to provide a maximum aperture opening to facilitate liquid exit; and which are also shaped so as to promote shedding of liquids from the guide ribs themselves. Additionally, a particularly preferred embodiment of coin receiving assembly includes a liquid deflection surface generally aligned with the coin entrance, and configured to deflect and guide liquids toward the exterior of the assembly. In this preferred embodiment, the liquid deflecting member is formed as a preceding portion of a structure forming a protrusion which defines an arcuate coin path. This configuration places the liquid deflection member optimally proximate the point whereby the maximum separation of liquid from the coin path may be achieved.

BRIEF DESCRIPTION OF THE DRAWINGS

FIG. 1 depicts an exemplary coin receiving assembly in accordance with the present invention, illustrated from a side oblique view.

FIG. 2 depicts the coin receiving assembly of FIG. 1 from a direct side view.

FIG. 3 depicts the coin receiving assembly of FIGS. 1–2 from a coin exit end along lines 3—3 in FIG. 2.

FIG. 4 depicts the coin receiving assembly of FIGS. 1–2 from a coin entrance end along lines 4—4 in FIG. 2.

FIG. 5 depicts the coin receiving assembly of FIGS. 1–2 from a bottom view.

FIG. 6 depicts the coin receiving assembly of FIGS. 1–2 from an opposing side view from that depicted relative to FIG. 2.

FIG. 7 depicts the coin receiving assembly of FIGS. 1–2 from a generally horizontal cross-section along lines 7—7 in FIG. 6.

DETAILED DESCRIPTION OF PREFERRED EMBODIMENTS

Referring now the drawings in more detail, and particularly to FIGS. 1, 2, 6 and 7, therein is depicted an exemplary coin receiving assembly 10 in accordance with the present invention. Coin receiving assembly 10 includes a housing assembly which is preferably formed of two engageable housing sections 12 and 14. Housing sections 12 and 14 cooperatively define a coin entrance slot 16 on a receiving end 18 of coin receiving assembly 10. As is also depicted in FIG. 2, housing sections 12 and 14 cooperatively define side surfaces which define a coin race 20 which is generally adapted to maintain a coin 21 in a rolling, on-edge, orientation as it traverses coin race 20. Additionally, housing sections 12 and 14 cooperatively define a downwardly sloping coin race floor 22. In this particularly preferred embodiment, coin race 20 includes side surfaces which are formed, at least in part, by a plurality of appropriately formed generally parallel and preferably multi-angular guide ribs, situated in spaced and generally parallel planar orientation, which collectively form an upper portion of one side surface of coin race 20. Although in a currently preferred embodiment, these ribs lie in parallel planes, the ribs could also be arranged in angled or staggered relation to one another. As can be seen in FIG. 2, housing section 12 includes four such guide ribs 24*a–d*. In this particularly preferred embodiment, each guide rib 24*a*, 24*b*, 24*c* and 24*d* extends in generally parallel relation to downwardly sloping coin race floor 22. Additionally, the various surfaces which collectively form coin race floor 22 and adjacent surfaces slope gently away from the center of coin race 20 and toward the exterior of the housing assembly. It can also be seen that housing section 14 includes two guide ribs 26*a*, 26*b* which define the majority of the generally opposing side surface of coin race 20 within the housing assembly.

The described ribs 24*a–d* and 26*a–b*, and coin race floor 22 cooperatively define a generally rectangular cross-section to coin race 20, although the specific dimensions of the coin race may vary along the length of coin race 20. The ribs 24*a–d*,26*a–b* will be placed relative to coin race floor 22 to control coins of the desired size(s) and to maintain these coins in an on-edge orientation.

In a particularly preferred embodiment, guide ribs 26*a–b* are vertically offset from guide ribs 24*a–d*. This vertical offset (as best seen in FIG. 4) helps to avoid water bridging between the two sets of ribs 24*a–d*, 26*a–b* forming the two sides of this portion of coin race 20.

As can best be seen in FIG. 7, coin race 20 is defined by housing sections 12 and 14 to define an at least partially arcuate path, as indicated generally at 28. This arcuate path 28 causes a coin 21 to move from a first lateral position at coin entrance slot 16 to a second, laterally offset position around a protrusion 30 and to return to a third laterally offset position approximately aligned with the first lateral position at coin entrance slot 16. In the depicted preferred embodiment, these first, second and third positions are offset from one another along an axis parallel to that along the axis 23*a* or 23*b* along a cross-section across coin race floor 22.

Protrusion 30 is cooperatively formed in part by ribs 24*a–d* and in part by a deflecting vane 34. Deflecting vane 34 and ribs 24*a–d* cooperatively form a continuous and generally smooth inner sidewall profile 36 to coin race 20. On the outer side, the forward-most extent 38 of vane 34 preferably forms a reasonably sharp contour. The exterior surface 40 of vane 34 has a generally arcuate shape curving outwardly, toward the exterior of coin receiving assembly 10.

The dimensions of protrusion 30, and of the remainder of coin receiving assembly 10 may be determined in reference to the specific application to be addressed. In the exemplary embodiment depicted, coin race 20 defines a path approximately 4 inches long, of which protrusion 30 defines an arcuate path for approximately 2 inches, and defines a maximum lateral affect of approximately 0.375 inch.

Proximate the lower portion of coin race 20, the coin race floor 22 becomes discontinuous, and bridges a plurality of apertures 42*a–d* which extend from coin race 20 to a location exterior of the coin race, and preferably exterior to housing sections 12 and 14. Beyond apertures 42*a–d*, coin race 28 terminates at a coin exit 44. A coin totalizing assembly or other mechanism will typically be coupled to coin receiving assembly 10 to receive coins exiting coin exit 44.

As can best be seen in FIGS. 2 and 6, on the "downstream" side of vane 34 is an aperture 46 which extends through a web 48 defining that portion of the left side surface of coin race 20. Aperture 46 extends in web 48 to a depth beneath coin race floor 22, and engages an aperture 42*a*. Although water may cling to coin race sidewalls and travel around protrusion 30, it will not have sufficient momentum to cross aperture 46. Accordingly, the water will drain out the associated aperture 42(*a–d*). Aperture 46 may be dimensioned in reference to the particular implementation to assure that water will not rise over the top of aperture 46 to travel along web 48.

Referring primarily to FIGS. 4 and 6, it can be seen that the outer edges 52 of each guide rib 24*a–d*, 26*a–b* are rounded so as to promote the shedding of any liquid which might be on the rib edge. Additionally, the inner portion of each guide rib contains a generally arcuate inner and lower surface 54 to further promote the shedding of any liquids toward the exterior of housing section 14. Similarly, the inner surfaces of guide ribs 24*a–d* of housing section 12 include a generally arcuate inner profile for the same purpose.

Additionally, as can best be seen in FIG. 1, the height of coin race floor 22 is elevated by a ledge 56 relative to the reminder of housing section 12. A similar ledge 58 is present on the opposite side, in housing section 14. These ledges 54 and 56 serve to promote and maintain separation of liquids from coin race floor 22.

Guide ribs 26*a*, 26*b* terminate at a lower end at an inclined member 60 having a generally sharp contour proximate an inner surface of coin race 20, and an inclined surface 64 extending outwardly, so as to direct any liquids encountering surface 64 outwardly and away from coin race 20.

While not wishing to be bound by theory, aspects of the perceived operation of the invention will be described. During the intended function of receiving a coin through coin inlet slot 16, the coin will be guided through coin race 20, being deflected from an initial position to a generally laterally offset position adjacent deflection point 30, and then guided generally back in the opposite direction to an exit position which is preferably approximately aligned with coin inlet slot 16. The coin is maintained in a rolling, on-edge orientation, as it is directed through coin race 20 through interaction of the upright coin with guide ribs 24*a–d* and 26*a–b*.

During a period when a vandal is attempting to insert liquid through coin inlet slot 16, depending upon the force and the exact direction of the water, the liquid can travel through inlet slot 16, but exit through apertures 25*a–d* formed between ribs 24*a–d*. As water continues to flow downwardly, it will hit the rearward side of vane 34. The generally curvilinear exterior profile of vane 34 will further direct liquids on the exterior side of vane 34 toward the exterior of housing section 12. Conversely, water which manages to pass on the race side of vane 34 is already being directed outwardly relative to housing section 14, and apertures 27*a–c* defined in part by guide ribs 26*a–b* serve to allow liquid exit generally continuously along the curvilinear portion of coin race 20. Further, because of the curvilinear cross-sections as described and illustrated earlier herein of guide ribs 24*a–d* and 26*a–b*, liquid which engages one of these guide ribs, will be directed by these curvilinear profiles to fall off the guide ribs. Further, as can be clearly seen relative to guide ribs 26*a–b* in housing section 14, the curvilinear underside of each rib promotes movement of any liquid under a rib toward the exterior of housing section 14. Further, as to any liquids which might traverse coin race 20 past vane 34, aperture 46 both provides a first drain area for such liquids, and also prevents the establishing of a vacuum on the rearward side of vane 34 which might otherwise cause liquids to tend to cling or flow to the sidewall of race 20. Additionally, drain apertures 42*a–d* in the floor of coin race 20 provide an additional fail safe mechanism by which remaining droplets of liquid are precluded from reaching beyond coin exit 44. The successive apertures 42*a–d* act as a pressure step to reduce the pressure of any fluid reaching these apertures sufficiently to facilitate drainage through at least one of apertures 42*a–d*. Accordingly, liquids are directed to locations of collection, where they will have minimal impact upon the machine, and are prevented from reaching expensive and sensitive electronics. Additionally, dust or other dirt can exit coin race 20 through apertures 42*a–d*.

Many modifications and variations may be made in the techniques and structures described and illustrated herein without departing from the spirit and scope of the prevent invention. Accordingly, the embodiments described and illustrated herein are illustrative only, and are not to be considered as limitations upon the scope of the present invention.

What is claimed is:

1. A coin receiving assembly, comprising:

a housing assembly defining a generally downwardly sloping coin race, said coin race including a generally downwardly sloping race floor, and having a generally arcuate path defined in part by protrusion around which a coin must pass to traverse said coin race, said coin race further defined in part by first and second pluralities of elongated guide members on each side of said race, said guide members established in spaced relation to generally retain a coin in an on-edge orientation while defining first and second pluralities of apertures between said race and a location generally exterior to said housing.

2. The coin receiving assembly of claim 1, wherein said guide members extend in generally parallel relation to one another and to said sloping floor of said coin race.

3. The coin receiving assembly of claim 1, wherein said protrusion is formed in part by at least a portion of said first plurality of elongated guide members.

4. The coin receiving assembly of claim 3, wherein said housing assembly comprises a coin entrance at a first location, and wherein said protrusion defines a second, laterally offset position relative said first location, and wherein said coin race defines a position laterally offset from said second position in the direction of said coin entrance.

5. The coin receiving assembly of claim 1, further comprising a liquid deflecting member configured to deflect at least a portion of liquids away from said coin race.

6. The coin receiving assembly of claim 4, further comprising a liquid deflecting member which cooperates with at least a portion of said guide members to form at least a portion of a sidewall of said coin race.

7. A coin receiving assembly comprising:

a housing assembly defining a coin race having a coin entrance and a coin exit, and having a floor and first and second side surfaces, said housing assembly defining an at least partially curvilinear coin path in said coin race, said first and second side surfaces defining paths of liquid communication between said coin race and a location exterior to said coin race; and a diverting member positioned proximate said coin entrance and configured to deflect at least a portion of liquids entering said coin entrance toward at least one of said first and second side surfaces.

8. The coin receiving assembly of claim 7, wherein at least one of said side surfaces is formed at least in part by a plurality of generally longitudinal guide members in spaced relation to one another, said guide members having interior surfaces configured to define a portion of said coin path.

9. A coin receiving assembly defining a coin race and configured to separate liquids from said coin race, comprising:

a housing assembly defining said coin race, said coin race defined within at least an partially arcuate section, said coin race defined in part by spaced guide members establishing apertures providing liquid communication from inside the said race coin to locations exterior to said coin race on at least two sides thereof, said at least partially arcuate coin race defined in part by a generally solid member proximate said apertures on at least one side of said coin race.

10. A coin receiving assembly, comprising:

a housing assembly, said housing assembly defining a coin race having a generally rectangular cross-section defining a first side of a dimension which is less than a dimension of a second side, said cross-section configured to receive a coin from a coin entrance and to maintain said coin in a desired orientation relative to an axis generally parallel to said shorter dimension;

said coin race defining a generally arcuate path for said coins, said arcuate path curving around a protrusion, the arcuate deflection of said coin path being generally in a direction generally parallel to said narrower dimension of said generally rectangular cross-section, said coin race having said generally rectangular cross-section from at least a first side of said protrusion to a second side of said protrusion;

said coin race formed at least in part by elongated rib members defining apertures on first and second sides of said coin race; and said coin race further comprising a deflecting member placed proximate a coin entrance and configured to deflect fluids toward said apertures in at least one of said first and second sides.

11. The coin receiving assembly of claim 10, wherein said coin race forms at least a portion of a first side of said coin race, and wherein said elongated rib members define a portion of said second side of said coin race generally opposite said protrusion.

12. The coin receiving assembly of claim 10, wherein said coin race further comprises a coin race floor, said coin race floor being placed to support an edge of said coin, and to thereby form at least a portion of said smaller dimension of said generally rectangular cross-section.

13. The coin receiving apparatus of claim 12, wherein said coin race floor slopes downwardly from said coin entrance to a coin exit.

14. The coin receiving assembly of claim 10, wherein said housing further defines a coin race floor which defines a portion of said rectangular cross-section, and wherein said housing assembly further comprises apertures on said first and second sides of said coin race and in fluid communication with said coin race floor, said coin race floor configured to promote flow of fluids from said coin race toward said apertures.

* * * * *